United States Patent [19]

Mueller

[11] 4,072,087

[45] Feb. 7, 1978

[54] DIGITAL POSITIONER FOR REMOTE ACTUATION OF A CONTROL VALVE

[75] Inventor: James P. Mueller, East Peoria, Ill.

[73] Assignee: Caterpillar Tractor Co., Peoria, Ill.

[21] Appl. No.: 614,047

[22] Filed: Sept. 17, 1975

[51] Int. Cl.[2] ..... F15B 11/08; F15B 13/043

[52] U.S. Cl. ..... 91/461; 91/459; 92/13.1; 92/13.4; 92/13.6; 137/625.64; 137/625.66

[58] Field of Search ..... 92/13, 13.1, 13.6, 13.4, 92/13.5, 62, 65; 91/461, 304, 167, 459; 137/625.63, 625.66, 625.64

[56] References Cited

U.S. PATENT DOCUMENTS

| | | | |
|---|---|---|---|
| 356,538 | 1/1887 | Hubner | 92/13.6 |
| 2,157,240 | 5/1939 | Keel | 91/167 X |
| 2,577,462 | 12/1951 | Hackney | 91/167 |
| 2,596,471 | 5/1952 | Densmore et al. | 92/13.1 X |
| 2,922,397 | 1/1960 | Haanes | 92/13.6 X |
| 3,168,854 | 2/1965 | Neilson | 92/131 X |
| 3,187,637 | 6/1965 | Edmund | 91/167 |
| 3,198,212 | 8/1965 | Junck et al. | 137/625.69 X |
| 3,213,886 | 10/1965 | Pearne | 92/13.1 X |
| 3,220,318 | 11/1965 | McGuire | 137/625.66 X |
| 3,736,958 | 6/1973 | Rostad | 137/625.64 X |
| 3,800,671 | 4/1974 | Coleman et al. | 91/459 |

FOREIGN PATENT DOCUMENTS

| | | | |
|---|---|---|---|
| 301,531 | 11/1917 | Germany | 91/167 |

*Primary Examiner*—Irwin C. Cohen
*Attorney, Agent, or Firm*—Phillips, Moore, Weissenberger, Lempio & Majestic

[57] ABSTRACT

A digital positioner for remote actuation of a control valve includes a double-acting actuating piston connected to the control valve and a plurality of fluid-responsive stop means disposed to either side of the actuating piston. A plurality of remotely controlled pilot valves are operatively connected to respectively control the actuating piston and selected ones of the stop means. The system is especially adapted for remotely controlling hydraulic systems having a control valve for modulated control of the system for different speeds of the system.

5 Claims, 2 Drawing Figures

LOGIC
RAISE & DUMP
LOWER & RACK BACK
A
B
C
D
H
O
L
D

R H L

DIGITAL POSITIONER FOR REMOTE ACTUATION OF A CONTROL VALVE

BACKGROUND OF THE INVENTION

The present invention relates to hydraulic control systems and pertains particularly to a digital positioner for a remote hydraulic control valve.

It is frequently desirable to operate a hydraulic machine from a remote location. Such a remote location may be desirable, for example, in mining operations wherein the dangers of caving or the like presents a hazard to the machine operator. Other environments may also present hazardous conditions to the operator of the vehicle.

Considerable control for remote operation may also permit an operator to operate a plurality of machines in tandem. Such remote operation of machines is not too difficult where the valves for the hydraulic system are either fully open or fully closed. Such operation does, however, become a problem when it is desirable to operate a system with the control valves at intermediate positions between full open and full closed.

Remote control of a movable machine is difficult to achieve by hydraulic control means from a remote location. Such remote control is usually achieved by radio control or by electrical conductor cables or the like. With such an arrangement, the electrical control may either control a main valve or a pilot control system. A difficulty with such electrical control is that intermediate stops between full open and full closed is not easily achievable by low cost electrical control.

Furthermore, it will also be appreciated that certain hydraulically controlled machines have implement functions remote from the operator requiring pilot systems. Also, high horsepower hydraulic systems require pilot systems to overcome high actuating forces. Electrical control systems replace pilot lines with electrical lines that are more economical, less cumbersome and leak free. Electrical control offers remote control between the operator on the vehicle and the implement valve.

It will also be appreciated that certain hydraulically controlled machines have implements that perform functions in sequence. For example, such machines have a tool or implement that performs one function and immediately thereafter performs a second related function. These functions are normally performed in specified sequence.

Hydraulic loaders are examples of machines having such a function. For example, a loaded bucket is raised to a given height and following this raise to that height the bucket is dumped. Thereafter, the bucket is lowered to ground level and, after being moved forward for loading, is then racked back, that is, tilted back to reduce spillage as the load is raised for dumping into a vehicle or the like. It will be appreciated that numerous other machines having examples of such sequence operation exist.

These sequence functions can be controlled by a single control valve being movable to a first position for the first function and thereafter moved further to a second position for the second function. Such control is normally carried out by the operator, who moves the directional control valve to a first position for selecting the first function and thereafter moving the valve further to its second position for activating or accomplishing the second function.

It is desirable to free the operator of these many functions when possible. Accordingly, it is desirable to find automatic means capable of performing this function without constant attention of the operator.

SUMMARY AND OBJECTS OF THE INVENTION

It is the primary object of this invention to overcome the above problems of the prior art.

Another object of the present invention is to provide means for selectively positioning a directional control valve of a hydraulic machine from a remote location.

A further object of the present invention is to provide digital positioning means for selectively positioning a directional control valve of a hydraulic machine at intermediate positions between full open and full close.

Still another object of the present invention is to provide remote digital control means for remotely positioning a control valve of a hydraulic machine in a specified selected number of different positions.

In accordance with the primary aspect of the present invention, digital positioning means is provided for positioning a control vavle for selectively moving the control valve from a neutral position to selected operative positions to either side of the neutral position for operation of separate hydraulic motors and/or operation at different rates.

BRIEF DESCRIPTION OF THE DRAWINGS

The above and other objects and advantages of the invention will become apparent from the following description when read in conjunction with the drawings, wherein.

DETAILED DESCRIPTION OF PREFERRED EMBODIMENTS

Figures 1, 2:
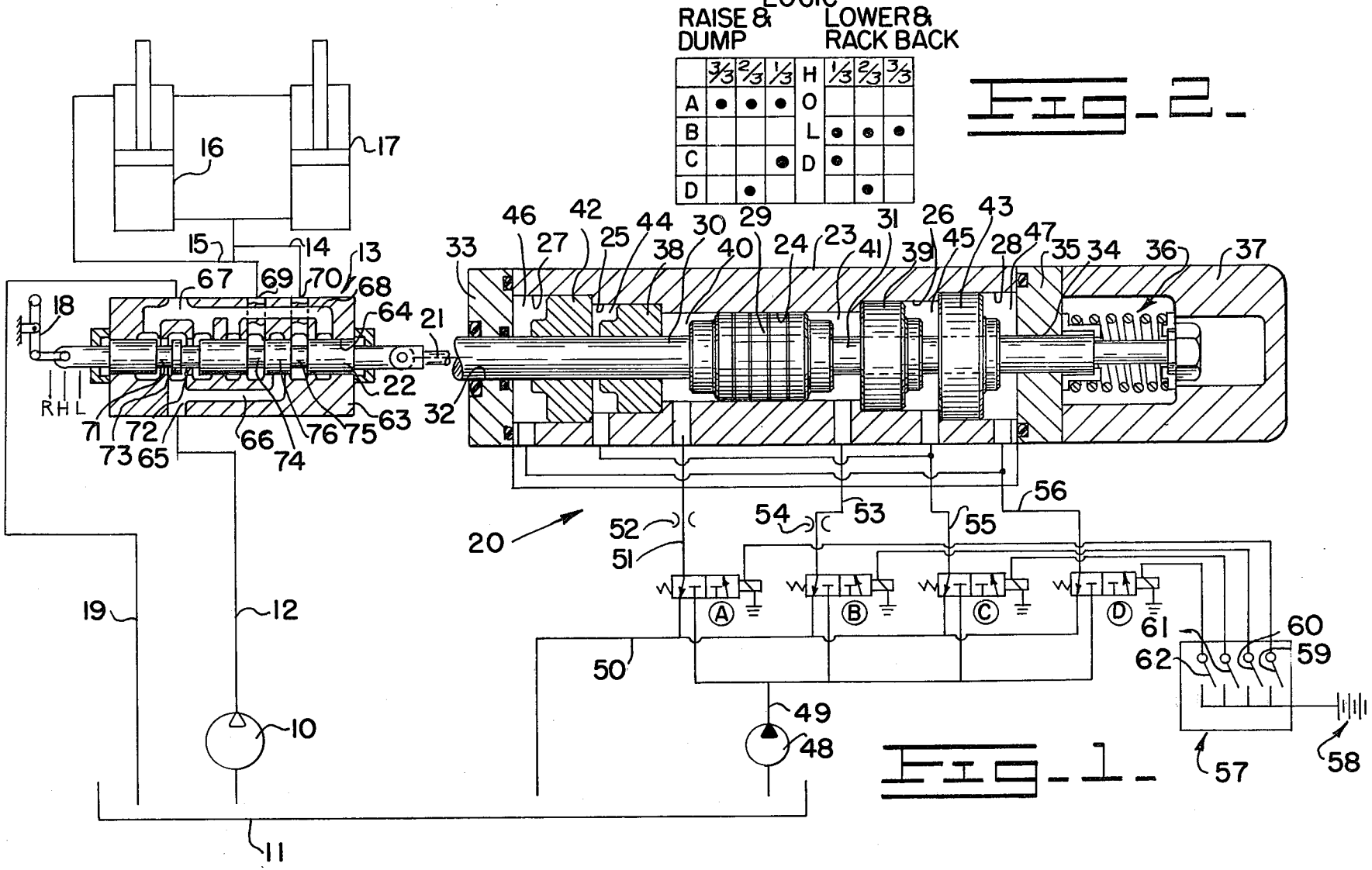
FIG. 1 is a schematic layout of a hydraulic system incorporating a first embodiment of the present invention.
FIG. 2 is a logic diagram of the control positions of the illustrated embodiment.

As illustrated in FIG. 1, a primary pump 10 draws fluid from a reservoir 11 and supplies it by a supply line 12 to a main directional control valve 13. This primary source of pressurized motive fluid is then directed selectively by means of control valve 13 by way of either one of motor control lines 14 or 15 to either end of a pair of double-acting fluid motors 16 and 17. The control valve 13 may be suitably positioned and adapted for manual actuation and control by means of suitable control handle means 18 or it may be purely remotely controlled. The valve 13 is operative to direct the fluid to and from the motors 16 and 17 and return the fluid by way of a line 19 to the reservoir 11.

The control valve 13 may be of any suitable type but may preferably be a reciprocable spool type mounted in a housing and having an open centered position defining neutral or hold position and selected positions to either side of the neutral for directing fluid to the motors 16 and 17. The spool will be operative to modulate or control the rate of flow of fluid thereby with the degree of displacement from its neutral or hold position.

A hydraulic system may, for example, be the system for a hydraulic loader and having a raise position, a hold or neutral position, a dump position, a lower position, and a rack back position. The system then may be provided with suitable remote control means for selecting these positions.

Digital positioning means indicated generally by the numeral 20 is operatively connected such as by a control rod 21 to the valve spool 22 of the control valve 13 for selectively positioning the valve spool 22 in either one of a number of operative positions.

The digital positioning means includes an actuator which is fluid pressure-responsive and includes a housing 23 having a stepped symmetric through bore having a first bore 24 of a first diameter, a second pair of bores to either concentric width and at each end thereof 25 and 26 of slightly larger diameter, and a second pair of bores 27 and 28 further outward thereof. Double-acting piston 29 is reciprocably mounted within the central bore 28 and includes a piston rod 30 extending one direction therefrom and connected to connecting rod 21 and a second rod 31 extending in the opposite direction therefrom. The first rod 30 extends through the bore 32 in a first end cap 33 of housing 23 and the second rod 31 extends through the second bore 34 in an end cap 35 on the opposite end of the bore of housing 23. Suitable centering means 36 including a centering spring, is secured to the outer end of the rod 31 for returning the valve spool 13 to its neutral or fully off position as a fail-safe means. A cap 37 is secured to the end plate 35 of housing 23 and covers the centering spring means.

A first pair of annular stop members 38 and 39 are mounted respectively in the first pair of stepped bores 25 and 26 for defining stop means for the piston 29 and for defining therewith a first pair of pressure chambers 40 and 41 at either end of the double-acting piston 29. A second pair of annular stop members 42 and 43 are reciprocably mounted within the second pair of step bores 27 and 28 and serve with the other further stop means for piston 29 and define in conjunction with the first set of stop means a pair of annular pressure chambers 44 and 45.

The second pair of stop members 42 and 43 also define with the end covers 33 and 35 a third set of pressure chambers 46 and 47. Pilot means for controlling the above-described actuator comprises a source of pilot fluid comprising a pilot pump 48 drawing fluid from a reservoir, such as reservoir 11, and supplying it by way of the supply line 49 with suitable branch lines to a series of pilot-controlled solenoid-actuated valves A, B, C and D. A return line 50 is connected to each of the above-mentioned pilot valves by suitable branch lines as illustrated.

The first pilot valve A is operative to selectively direct fluid by way of line 51 to chamber 40 for pressurizing the chamber and moving the actuator piston 29 to the right against suitable stop means for moving the control valve 13 from its hold position. The valve A is similarly operative in its illustrated position, to which it is normally biased for venting chamber 40. A restriction 52 is provided in line 51 for controlling the rate of pressurization of the chamber 40.

The second pilot valve B is operative to direct fluid by way of a pilot line 53 to chamber 41 for pressurizing that chamber and moving piston 29 to the left against selected stops. A suitable restriction means 54 may be provided in line 53 for controlling the rate of supply of fluid to the chamber 41. The valve is also operative in its illustrated position to which it is normally biased for venting the said chamber 41 to permit the actuator to return the control valve to the neutral or hold position.

The pilot valve C is operative to direct fluid along line 55 for pressurizing chamber 45 to thereby activate stop 39 and maintain in its illustrated position to thereby stop the piston 29 at that position. The valve C is also operative in its illustrated position to which it is normally biased by illustrated spring means for venting the chamber 45 to permit free movement of the stop means 39. The line 55 also branches to similarly supply fluid to chamber 44 to similarly activate stop means 38 and maintain in its position or to likewise vent the chamber 44.

The pilot valve D similarly is operative to direct fluid along conduit 56, which branches to supply fluid to both of chambers 46 and 47 to thereby pressurize these chambers and activate stops 42 and 43 and maintain them in their illustrated positions to thereby stop the piston 29 upon movement to either one of these respective positions. Similarly, the valve D is operative in its illustrated position to which it is normally biased for venting the respective chambers 46 and 47 by way of the lines 56 to the return line 50.

Each of the pilot valves A through D is solenoid-controlled from a remote location. Each valve is controlled separately by a separate switch in a bank of switches indicated generally at 57. This bank is connected to a source of power or current 58 for selectively supplying the current for activation of each of the valves A through D. A first switch 59 controls actuation of the valve A for moving it from its illustrated position to a fluid-directing position. A second switch 60 directs current to solenoid B for actuation of valve B. A third switch 61 selectively directs current to actuation of valve C. A fourth switch 62 supplies current for actuation of valve D.

Selective actuation of selected one of these switches as illustrated in the logic chart or table at FIG. 2 provides the indicated selective remote actuation and control of the system. Thus, if partial opening of valve 13 is desired, a selected stop switch is activated prior to actuation of the piston actuating valves A or B which are operative to activate the piston 29 up to the selected stops. The valves A or B are operative to control the direction of the piston 29 and the valves C or D are operative to select the respective stops to which the control valve 13 is moved.

The system as illustrated is biased to its neutral or hold position. Looking to FIG. 2 it is seen that the valve may be shifted $\frac{1}{3}$ to the right by closing switches 59 and 61 to shift pilot valves A and C, or shifted $\frac{1}{3}$ to the left by closing switches 60 and 61 to shift pilot valves B and C. The valve can be shifted $\frac{2}{3}$ open by closing switch 62 for shifting valve D for activating the 2/3 stops, and by closing either one of switches A or B for the direction of shift. In a similar manner the valve 13 may be shifted to full open by closing either one of switches 59 or 60 depending on the desired direction of shift.

The valve 13 by way of example comprises a housing 63 in which is formed a cylindrical bore 64 in which is reciprocably mounted the valve spool 22 for controlling the communication of fluid from supply line conduit 12 to the motor control lines 14 and 15.

The housing includes an inlet passage 65 having a branch 66 and communicating at spaced points with the bore 64. A first exhaust passageway 67 communicates the bore with outlet or exhaust conduit 19. A second exhaust passageway 68 communicates at spaced points of the bore adjacent a pair of motor control ports 69 and 70 communicating therewith.

The spool 22 includes a first pair of annular grooves 71 and 72 spaced apart and separated by a land 73 providing an open center means for normal communication of inlet passage 65 with exhaust passageway 67. A second pair of grooves 74 and 75 separated by a land 76 controls communication of fluid between branch 66 of the inlet passage and the motor control ports 69 and 70 and between the motor control ports and the exhaust passage 68.

It will be appreciated that movement of the spool 22 to the right sufficient to move the left-hand edge of land 76 beyond the edge of passage 66 will provide communication between the passage 66 by way of groove 74 with motor control port 69. At the same time communication will be provided between motor control port 70 and exhaust passage 68 by way of annular groove 75.

It will also be appreciated that the degree of communication between the respective passages will also be dependent upon the degree of movement of the spool 22 to the right. Similar movement of the spool 22 to the left provides similar communication between corresponding other passages within the valve spool. This movement of the valve 22, either to the right or the left, also blocks communication between inlet passage 65 and the exhaust passage 67 by means of land 72 of the spool as well as the enlarged portions of the spool to either side of the grooves 71 and 72.

Thus, the valve as illustrated and as described will function in combination with the digital positioner as described above to provide the respective rates of fluid flow as specifically described above.

It is obvious from the above that any number of stops may be used and numerous modifications made in the illustrated embodiment without departing from the spirit and scope of the invention as defined by the appended claims.

I claim:

1. A hydraulic system having a remotely controlled positioner for a hydraulic control valve for fluid-operated mechanism, comprising:

an inlet and exhaust hydraulic control valve wherein said valve has a spool reciprocably mounted within a cylindrical valve bore and which is movable to intermediate positions between fully open and fully closed positions for controlling the flow of fluid between an inlet and an outlet of said valve;

a positioner housing having a cylindrical bore, said bore having a central region and a pair of intermediate regions each adjacent an opposite end of said central region and further having a pair of outer regions each adjacent a separate one of said intermediate regions;

a double acting piston reciprocably mounted in said central region of said bore and having a rod extending axially from said bore through said opposite regions of said positioner housing and spring means associated with said positioner for biasing said piston towards a central position in said central region of said bore;

a first pair of movable fluid-controlled stop means each being disposed in a separate one of said intermediate regions of said bore for axial movement therein, and a second pair of movable fluid controlled stop means, each being disposed in a separate one of said outer regions of said bore for axial movement therein wherein the face areas of each of said stop means exceed the face area of said double-acting piston;

a first pair of abutment means each being situated between said central region of said bore and a separate one of said intermediate regions thereof for limiting movement of said first pair of stop means towards said central region of said bore, and a second pair of abutment means each being situated between a separate one of said outer regions of said bore and the adjacent one of said intermediate regions thereof for limiting movement of said second pair of stop means towards said intermediate regions of said bore;

a source of pilot fluid;

a first pilot valve means for selectively directing fluid from said source to one end of said central region of said bore for moving said piston towards the other end thereof, a second pilot valve means for selctively directing fluid from said source to said other end of said central region of said bore for moving said piston towards said one end thereof, a third pilot valve means for selectively directing fluid from said source to both of said intermediate regions of said bore to move said first pair of stop means against said first pair of abutment means, and a fourth pilot valve means for selectively directing fluid from said source to both of said outer regions of said bore to move said second pair of stop means against said second pair of abutment means, and means external of said housing for connecting said rod to said valve spool for moving said valve to said positions.

2. The hydraulic system of claim 1 wherein:

said cylindrical bore of said positioner housing is a stepped bore with said intermediate regions thereof being of larger diameter than said central region of said bore and with said outer regions of said bore being of still greater diameter than said intermediate regions thereof, and said first pair of stop means comprise at least a pair of first piston means each being reciprocably situated in a separate one of said intermediate regions of said bore and said second pair of stop means comprise at least a pair of second piston means, each being reciprocably situated in a separate one of said outer regions of said bore, said first pair of piston means being of larger diameter than said piston and said second pair of piston means being of larger diameter than said first pair of piston means.

3. The hydraulic system of claim 1 wherein:

said double-acting piston has a rod extending from each end thereof; and, said first and second pairs of stop means comprise a plurality of annular piston means encircling said rod on each side of said piston.

4. The hydraulic system of claim 1 wherein said first, second, third and fourth pilot valve means are each solenoid operated from remotely positioned electrical switch means connected thereto by conductor means.

5. A digitally controlled hydraulic system comprising:

a primary source of pressurized motive fluid;

a reversible fluid motor;

means including a directional control valve for selectively directing fluid from said source to said motor and for receiving return fluid from said motor for selectively effecting forward and reverse operation of said motor;

said control valve having a central neutral position and a plurality of predetermined operative positions on each side of said neutral position; and, a digital positioning means for selectively moving said control valve from said neutral position to selected ones of said operative positions, said digital positioning means having a housing with a bore in which pressure-responsive double-acting piston is disposed for axial movement away from a central position therein and having a plurality of fluid-actuated stop means disposed in said bore in axially spaced relation from each end of said piston thereby defining at least two pair of stop means and having centering spring means for biasing said piston towards said neutral position;

a source of pressurized pilot fluid;

first pilot valve means for selectively directing fluid to said bore adjacent one end of said piston for moving said piston in one direction from said central position and second pilot valve means for selectively directing fluid to said bore adjacent the other end of said piston for moving said piston in the opposite direction from said central position;

a plurality of additional pilot valve means for directing pilot fluid to selected ones of said plurality of stop means for stopping said piston at said selected ones of said stop means; and, rod means extending from said piston and, extending through said two pair of stop means and from said positioning means to said control valve for connecting said piston to said control valve to externally of said housing shift said control valve to any selected one of said predetermined positions therein in response to operation of predetermined combinations of said pilot valve means.

* * * * *